United States Patent [19]

Bourque

[11] 4,327,514

[45] May 4, 1982

[54] CROSSARM YARD SIGN SUPPORT

[76] Inventor: George O. Bourque, 665 Jackson Ave., Winter Park, Fla. 32789

[21] Appl. No.: 247,822

[22] Filed: Mar. 26, 1981

Related U.S. Application Data

[63] Continuation-in-part of Ser. No. 50,667, Jun. 6, 1979, Pat. No. 4,258,494.

[51] Int. Cl.[3] ..... G09F 15/00

[52] U.S. Cl. ..... 40/607; 40/617

[58] Field of Search ..... 40/584, 606, 607, 617

[56] References Cited

U.S. PATENT DOCUMENTS

| | | | |
|---|---|---|---|
| 2,926,442 | 3/1960 | Reimel | 40/617 |
| 3,296,725 | 1/1967 | Fenwick | 40/606 |
| 4,219,179 | 8/1980 | Silbernagel | 40/606 |
| 4,249,715 | 2/1981 | Repp | 40/607 |
| 4,250,647 | 2/1981 | Woodard | 40/607 |
| 4,258,494 | 3/1981 | Bourque | 40/607 |

FOREIGN PATENT DOCUMENTS

| | | | |
|---|---|---|---|
| 1294217 | 4/1962 | France | 40/11 |
| 1325735 | 3/1963 | France | 40/11 |

*Primary Examiner*—Gene Mancene
*Assistant Examiner*—Wenceslao J. Contreras
*Attorney, Agent, or Firm*—Duckworth, Allen, Dyer & Pettis

[57] ABSTRACT

A crossarm type support having a vertical post formed from a rectangular tube having a set of internal splines. A spike element molded from polycarbonate plastic resin is inserted in the lower end of the post and held in place by a pair of spring loaded pins. The post is installed in the ground by pushing on a horizontal portion of the spike element with the heel of a shoe. A crossarm is provided at the upper end formed from a second rectangular tube having a first channel along its lower edge and a second channel along its upper edge. The vertical posts and crossarm are mortised to form complementary notches for mounting the crossarm to the post. The post and internal splines interlock with the crossarm and channels to provide internal support and rigidity to the joint. The lower crossarm channel is formed to receive plastic hooks for attaching a hanging sign and the upper channel is formed to receive a set of plastic inserts for receiving an interchangeable rider sign.

7 Claims, 7 Drawing Figures

CROSSARM YARD SIGN SUPPORT

This application is a continuation-in-part of co-pending application, Ser. No. 50,667 filed on June 6, 1979 now U.S. Pat. No. 4,258,494.

BACKGROUND OF THE INVENTION

1. Field of the Invention

The present invention relates to a post support for signs and the like and more particularly to a portable crossarm yard sign post.

2. Description of the Prior Art

Crossarm type sign support posts are widely used, particularly in connection with the sale of real estate where a sign is to be provided on the lawn or lots being advertised. When the signs are no longer needed, it is required that the support post be removed and reused.

It is common to install a post in a hole dug in the ground which is inconvenient and, in some cases, damaging to the property. Other approaches, as exemplified by U.S. Pat. No. 4,120,125 to Cvetan, have proposed a socket with a single downward projecting spike to be driven in the ground and the post inserted into the socket. The socket unit requires a special tool for driving the spike into the ground, the tool being removed and the post being inserted thereafter. A tool similar to an automobile jack is then required to remove the socket and spike from the ground.

In real estate work, it is usually desirable to provide a large sign offering the property for sale and carrying the name and logo of the real estate broker. Such signs may be standard and manufactured in large quantities to reduce the cost over a custom sign. When such standardized signs are used, it is often necessary to provide a rider type auxiliary sign to note special features concerning the property; for example, the number of bedrooms, a swimming pool, or other special features. Rider signs are also used to indicate when the property has been sold thereby providing favorable notice for the listing real estate broker.

There has been a need for real estate type sign supports, particularly for a lightweight, relatively low cost crossarm type sign support which can be quickly and easily installed on a lawn with minimum damage thereto and easily removable therefrom. Such a sign support must also be easily assembled to minimize cost, must be attractive to complement high quality residences and the like, and must have a long service life. A real estate sign support post is also needed that will allow rider type signs to be quickly and easily installed by a real estate salesman without tools and in which the rider signs can be quickly changed when required.

In co-pending patent application Ser. No. 50,067, the present inventor disclosed a crossarm type support post having the characteristics to meet the above noted need. The present specification discloses several improvements over that invention which have been found to add to the stability of the post and the ease of installation, and which presents certain advantages with respect to reuse of the post.

SUMMARY OF THE INVENTION

The present invention is a crossarm type support post for signs which is particularly adapted for real estate use and which meets all of the above mentioned requirements. The support post utilizes two novel extrusions which provide both functional and structural features.

An upright post section is provided which in one embodiment may be of an extruded rectangular tube-form having specially designed internal ribs. The crossarm portion may also be an extruded, rectangular, tube-like member having an upper channel for accepting an insert, and a lower channel into which sign retaining screws may be threaded. The cross-sectional designs of the upright post and the crossarm are made complementary to provide a rigid interlocking joint with no external bracing required. The lower end of the vertical post extrusion is adapted to receive a spike element molded from polycarbonate plastic resin available under the trade name of Lexan® from General Electric Co. An upper portion of the spike element fits the lower end of the upright post extrusion to form a snug, solid end for rigidity and strength. The spike assembly is securely attached to the tube by means of two spring loaded pins which permit quick installation and removal of the element. The lower end of the spike assembly consists of tapered blade portions at right angles attached to a broad horizontal plate with its upper face ribbed. The installer may force the blades into the ground by pushing downward on the horizontal sections with his foot or heel.

For lightweight and minimum cost, it is preferable that the vertical post extrusion and the horizontal crossarm extrusion be formed from aluminum and anodized. Caps of polypropylene or similar plastic material may be used to finish off the top end of the vertical post and each end of the horizontal crossarm for appearance and to prevent water intrusion. The channel in the top surface of the crossarm is formed to accept a set of novel inserts which may be of polypropylene or similar pliable plastic material. The inserts have a vertical cut in an upper portion to form a slot therein into which a thin rider sign may be inserted. A lower key shaped portion matches the shape of the upper channel and two or more inserts may thus be slipped into the channel and spaced appropriately along the crossarm. Due to the ability of the plastic insert to compress slightly, such an inserted sign is tightly gripped by friction between each insert and the sign but may be readily removed for change or dismantling. It is contemplated that the crossarm will support a main large sign hanging therefrom. For this purpose, a set of plastic eye devices is provided which accept S-hooks or the like for the hanging sign. Advantageously, the channel extruded along the lower surface of the crossarm material matches a key portion of the eye devices such that two or more of the eye devices may be inserted into the lower channel at any point along the channel to match the holes in the sign. This construction permits reuse of the post with any size sign.

As may now be recognized the crossarm type support post may be quickly installed on a lawn or in other ground without digging being required, a large sign hung from hooks at any desired location along the underside of the crossarm, and special rider signs quickly inserted and removed from grooves in the inserts mounted in the upper channel of the crossarm. Similarly, the support post may be quickly disassembled and removed when no longer required by unhooking the major sign, pulling the rider sign out of the slot, and by rocking the vertical post loosening the spike element, allowing easy removal from the ground.

It is therefore a principle object of the invention to provide a low cost, attractive, and lightweight crossarm type support post for yard signs and the like.

It is another object of the invention to provide a yard sign post that is quickly and easily installable and removable.

It is yet another object of the invention to provide a crossarm type yard sign post in which a rider sign can be inserted in the crossarm and in which the rider sign is quickly interchangeable.

It is a further object of the invention to provide a crossarm type yard sign support formed from metal extruded so that the crossarm forms a rigid cross joint with the upright post.

It is still a further object of the invention to provide a yard sign support post having a crossarm formed from a special extrusion having a groove along its top surface for accepting plastic inserts for holding a rider sign.

It is yet a further object of the invention to provide a yard sign support post having a crossarm extrusion in which eye devices can be quickly and securely engaged in the underside of the crossarm at any point along the arm for hanging of a sign.

It is another object of the invention to provide a crossarm type yard sign support having a base spike element for insertion into the ground which can be installed by foot pressure and does not require digging.

It is another object of the invention to provide a yard sign support post formed from extruded metal to accept a base spike element at the bottom end thereof to provide rigidity and strength and which can be quickly installed and removed.

It is another object of the invention to provide a crossarm type yard sign support post which may be quickly assembled and which will have a long service life.

These and other objects and advantages of the invention will become apparent from the following detailed description when read in light of the drawings.

DETAILED DESCRIPTION OF THE PREFERRED EMBODIMENT

Figure 1:
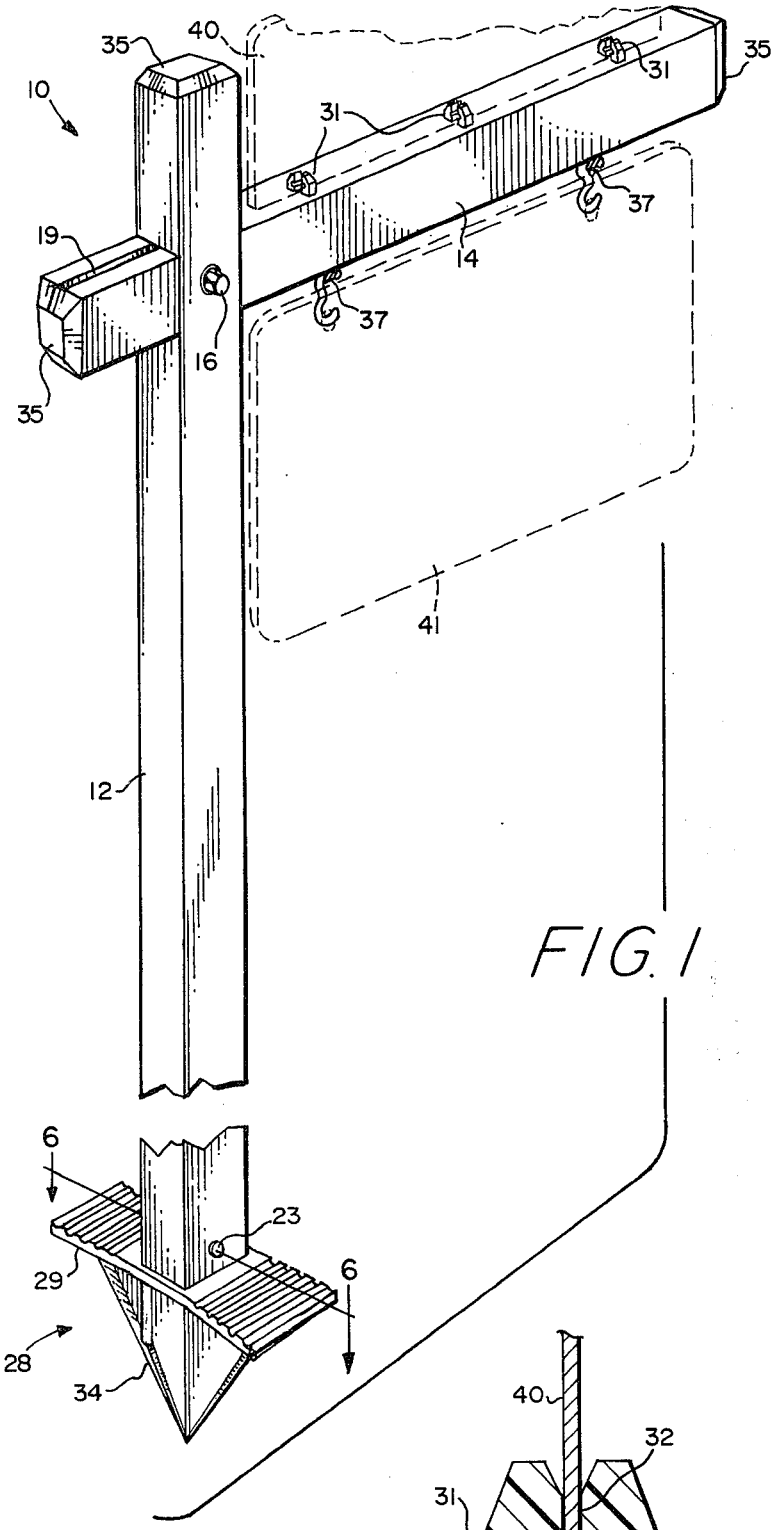
FIG. 1 is a perspective view of a crossarm type yard sign support post in accordance with the invention.
Figure 6:
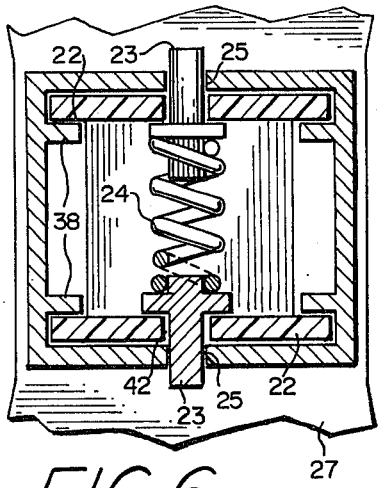
FIG. 6 is a cross sectional view 6—6 of FIG. 1 showing the fitting of the spike element into the support post.
Figure 7:
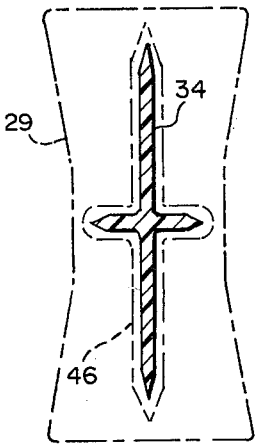
FIG. 7 is a cross sectional view 7—7 of FIG. 2 showing the spike element blades of the invention.

Referring to FIG. 1, a perspective view of a typical crossarm type yard sign support is shown which represents a preferred embodiment of the invention. Shown generally at 10, the support includes a vertical post 12 having a crossarm 14 attached at right angles thereto. The base of the post 12 is adapted to be installed in the ground by means of a spike element shown generally at 28 attached to the lower end of post 12. Spike element 28 is provided with spike blades 34 and horizontal section 29 which will allow the user to force spike blades 34 into the ground by pushing on step portions 29 with the foot or heel. The top surface of section 29 is ribbed to provide a non-slip surface and for reinforcement. Spike element 28 is molded in one piece, preferably from a polycarbonate plastic resin such as Lexan® which is extremely tough and strong. The use of Lexan® will provide a low cost, lightweight spike element which will have long life and will be very resistant to damage. As seen more clearly in FIG. 2, spike element 28 includes an upper insert portion 22 which is formed to fit into the vertical post extrusion 12, as shown by the cross section of post 12 in FIG. 6. Pins 23 are spring loaded by spring 24 and are held depressed when insert portion 22 is inserted into the lower end of post 12. Pins 23 will engage openings 25 in post 12 and will securely lock the spike element 28 in place. As may also be noted from FIG. 6, insert portion 22 is formed to fit snugly between splines 38 which greatly strengthens the lower end of post 12. To disassemble, it is only necessary to depress pins 23 sufficiently to allow the spike element 28 to be withdrawn. FIG. 7 provides a cross sectional view of integral blades 34 which are molded to have relatively sharp edges and which taper to a point for ease of insertion in the ground. The dashed line 29 indicates the horizontal portion 29 with dashed line 46 illustrating the blade shapes at the underside of horizontal portion 29. Crossarm 14 is attached to post 12 by bolt 16. The upper surface of arm 14 includes a groove or channel 19 extruded therein. Arm 14 extends a short distance on one side of post 12 and a greater distance on the opposite side to provide space for the signs to be attached. The dimensions of the short projecting end and the projection of the post above the crossarm are selected to provide both strength and an attractive appearance to the structure. The longer arm end of crossarm 14 permits plastic inserts 31 to be installed in channel 19 for acceptance of an auxiliary or rider type sign 40 which may be required to be changed occasionally. As will be described in more detail hereinafter, inserts 31 securely grip rider sign 40 yet allows convenient interchange of such signs. The underside of crossarm 14, as will be shown in more detail below, includes provisions for inserting plastic eye devices 37 therein from which to hang a large or main sign 41. Advantageously, such eye devices 37 may be inserted at any point along the underside of arm 14. Caps 35, which may be of molded plastic or the like, are utilized to finish off the open ends of the extruded arm 14 and post 12 for appearance and to prevent water intrusion.

Figures 2, 5:
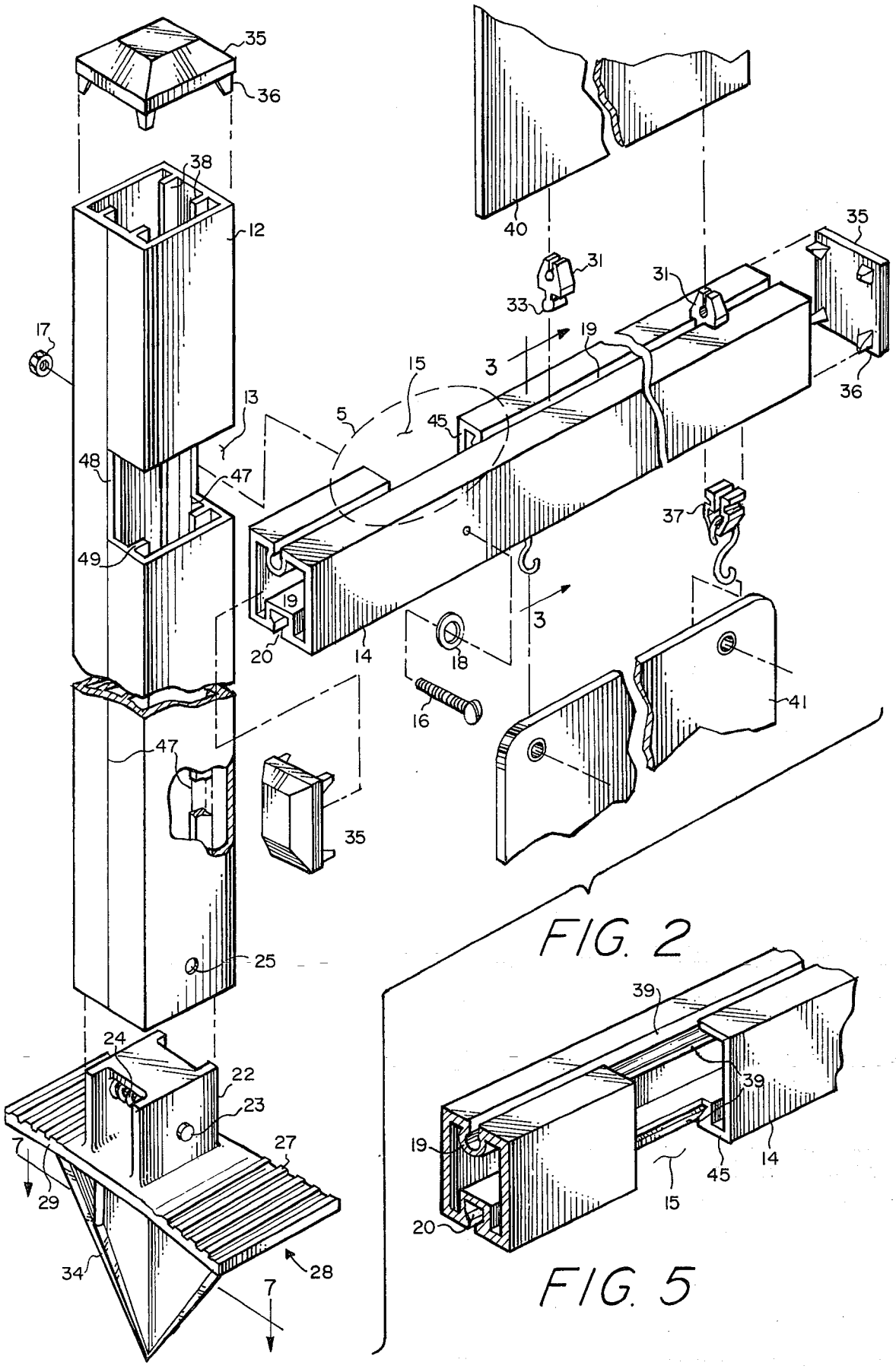
FIG. 2 is an exploded perspective view of the crossarm type yard support post showing the various features thereof.
FIG. 5 is a partial view of the crossarm of FIG. 2 in the encircled area 5 showing details of the crossarm cutout.

Turning now to FIG. 2, an exploded view of the yard sign support in accordance with the invention is shown and, in conjunction with the various detail figures, will be used to disclose the novel features of the invention. While various metals or other material of suitable strength may be used to fabricate the sign support of the invention, dependent on the desired size and weight of the signs to be supported, aluminum is the preferred material for real estate use and the like. Upright post 12 is preferably an aluminum extrusion having special functional internal splines 38 provided which also add structural rigidity and strength to the support. Functionally, the internal splines 38 support spike element 28 as well as simplify and reduce the cost of fabrication and assembly. In the preferred embodiment, post 12 is a rectangular shape, although the post may also be square, round, or other desired cross sectional shape. In one embodiment, post 12 and crossarm 14 have a face width of 2" and a depth of 1.75". Crossarm 14 is mortised to post 12 by means of mating cutouts 13, (in post 12) and 15 (in crossarm 14).

Figure 3:
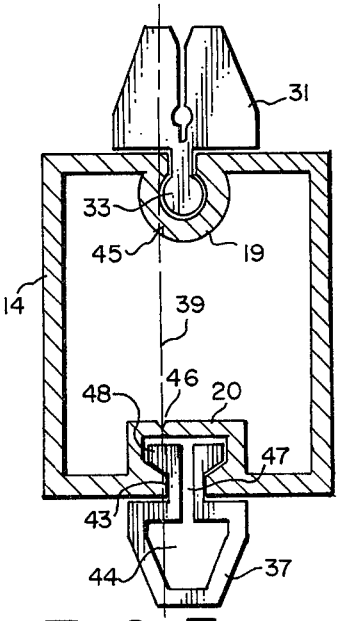
FIG. 3 is a cross sectional view 3—3 of the crossarm shown in FIG. 2.
Figure 4:
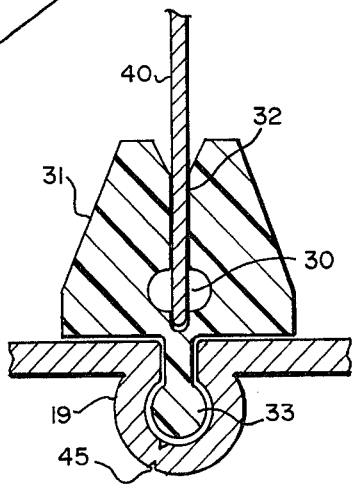
FIG. 4 is a partial cross sectional view of the crossarm showing one of the rider sign plastic inserts installed in the keyed channel, and a portion of a rider sign installed therein.

To facilitate cutting of cutouts 13 and 15 during production, grooves are scored in the respective extrusions. In post 12, grooves 47, which may be 0.005" in depth, are scored along the outside sides and along the inner surfaces as shown in the cutaway portion. Similar grooves are scored in the top and bottom portions of crossarm 14 best seen with reference to FIGS. 3 and 4. As seen in FIGS. 3 and 4, score marks 45 are extruded into the top surface of crossarm 14 immediately adjacent to channel 19. Marks 46 are extruded in the bottom surface of arm 14 along the base of one portion of lower channel 20 as seen in FIG. 3. To produce cutout 13, for example, two cuts are made on post 12 from one face halfway through the sides and spaced 2" to accept the face of crossarm 14. The cut portion may then be grasped, squeezed and rocked slightly causing the aluminum to cleanly break along the score marks 47, thus eliminating blind sawing operations. Similarly, as seen most clearly in FIG. 5, cutout 15 in crossarm 14 is produced by sawing through the appropriate face of the crossarm extrusion approximately halfway, spaced to produce a 2" wide opening to mate with post 12. Again, the cut section is removed by squeezing and bending to cause the metal to cleanly break along score marks 45 and 46. The internal splines 38 in post 12 and the extruded channels 19 and 20 in crossarm 14 cooperate to provide a rigid mortise when crossarm 14 is installed on post 12. At assembly, cutout 15 in crossarm 14 is fitted into cutout 13 and secured by bolt 16, washer 18, and nut 17. Advantageously, cutting of post 12 to form cutout 13 cuts through one pair of splines 38, producing lateral faces 49 for both top and bottom cuts. In conjunction with the cut face and sidewalls of post 12, the faces 49 provide a large bearing area contacting the upper and lower surfaces of crossarm 14 when installed. This bearing area therefore produces greater vertical strength and rigidity at the crossarm-post mortise joint than possible with wall area alone. Next, as best seen in FIG. 5, the cutout 15 in crossarm 14 produces bearing surfaces 39, which are the inside faces of channel 19 due to the offset from center line as shown in FIG. 3 and which bears against vertical wall section 48 of post 12. Similarly, one half of channel 20 in the bottom surface of crossarm 14 provides additional bearing surface against wall section 48. The construction increases the horizontal rigidity of the joint. Thus, the functional extrusions serve a two-fold purpose and here greatly minimize wear at the crossarm post joint which can occur due to the weight of signs and effects of wind on the structure.

In general, real estate brokers will utilize a large standardized metal sign 41 having the broker's name prominently displayed along with other general information with the appropriate for sale or for rent type legend thereon. It is contemplated that such a sign will be suspended below crossarm 14. To provide maximum flexibility, channel 20 is provided along the lower surface of arm 14 for accepting hardware to hang such a sign 41. Channel 20, as may be seen from the cross sectional view of FIGS. 3, consists of an essentially rectangular channel having a slot 43 opening downward. As extruded, channel 20 is closed at its top edges and has sloping lower faces. Plastic eye 37 includes an upper portion 48 slightly larger than rectangular channel 20 and formed complementary to the shape of that channel. A vertical slot 47 permits the upper portion 48 to be squeezed together. Thus, when a sign 41 is to be hung, a plastic eye 37, FIG. 3, is squeezed together to permit inserting into channel 20 and moved to an appropriate location along arm 14. The slight springiness of the plastic will keep eye 37 at the selected location while hanging the sign. Normally, two or more such eyes 37 would be inserted into channel 20 as required for the particular sign to be held. An S-hook is inserted in eye opening 44 and utilized to correct the sign to the eye 37.

In addition to the standardized sign which may normally be hung below arm 14, it is usually desirable to have a so-called rider sign or auxiliary sign carrying a specific or special message with regard to the property being advertised. For example, such signs may give the number of bedrooms, baths, indication of a swimming pool, and many other such messages. After a property is sold, or on which a sale is pending, it is common for the broker to maintain his sign on the property as long as possible for its general publicity value. He also desires to display a "sold" sign to emphasize his successful sale. It is therefore desirable that a rider sign indicating some feature of the property be easily removable and a sold sign installed in its place. Advantageously, in accordance with the invention, channel 19 which is an essentially cylindrical channel having an upward opening slot along its length and is utilized in conjunction with inserts 31 to provide this feature. As seen in FIG. 2 and in cross section in FIG. 4, insert 31 includes a lower key 33 which is inserted into channel 19 of arm 14 which has a complementary shape. Insert 31 may be fabricated from a pliable plastic material such as polypropylene or the like. It is formed to have a vertical groove or slot 32 along its center line and an opening 30 to permit slight spreading when inserting the sign 40. The upper portion of slot 32 may be outwardly tapered as shown in FIG. 4 to facilitate inserting of a thin rider sign 40 therein with the resiliency of the plastic producing sufficient friction to securely grip the sign.

To close off the open ends of the extrusions of crossarm 14 and post 12, decorative caps 35 may be provided. While caps 35 may be fabricated from a variety of material, a plastic such as polypropylene is suitable. Caps 35 have four wedge shaped corner projections 36 which form a forced fit into the inner corners of the extrusions. Caps 35 give a finished, attractive finish to the post and arm and also prevent water intrusion for protection of the metal. Spike element 28 is preferably formed from a polycarbonate plastic resin with a spike portion 34, and a step portion 29 at right angles to spike portion 34 and a vertical upward extruding portion 22 projecting at right angles from step section 29. Portion 22 is formed to fit snugly into the extrusion of post 12 as best seen in cross section in FIG. 6, thus assisting to maintain the rigidity of the lower portion of post 12. The wide faces of insert 22 straddle splines 38, as seen in FIG. 6, when inserted in the lower end of post 12. As may be also noted from FIG. 6, holes 42 through insert 22 match mounting holes 25 in the lower end of post 12 and spring loaded pins 23 will snap into holes 25 to secure spike element 28 to post 12. This novel design permits rapid installation and removal of spike element 28.

It is contemplated that the novel crossarm type yard sign support of the invention will be supplied to the user with the spike element 28 not yet installed in the post, a set of inserts 31 and 37 for the crossarm, and with the crossarm and post not connected. Thus, a unit is easily carried in a car or station wagon. To install, the user first installs spike element 28, and then stands the post upright on the spike blades at the desired location. He may then push the spike blades into the ground by stepping or standing on the step portions 29 of spike element 28. Where the ground is particularly hard, a block of wood may be used to tap the spike blades into the ground. Forcing the spike blades into the ground to the point where horizontal step portion 29 is flush with the ground produces maximum stability. Similarly, larger horizontal step portions 29 may be provided to give a greater area in contact with the ground for additional stability when necessary such as in very sandy soil. After the post is installed, the required mumber of inserts 31 and eyes 37 are inserted into channel 19 and 20. Crossarm 14 is then inserted in place on post 12 by interlocking notches 13 and 15 and inserting screw 16 with washer 18 through crossarm 14 and the back of vertical post 12. Lock nut 17 is then applied and tightened until snug. For portable and reusable applications, it may be desirable to use a wing nut to facilitate installation and removal without tools. The major sign is hung from the crossarm 14 on S-hooks from the eyes 37, the rider sign inserted into inserts 31 and the installation is then complete.

As may now be seen, a novel crossarm type yard sign support has been disclosed which is lightweight and rigid, and can be manufactured and assembled at relatively low cost. The support is quickly installed and supports a large major sign as well as an auxiliary or rider sign which may be easily removed and replaced. The strength and rigidity of the support is a result of the use of special extrusions for the vertical post and the crossarm in conjunction with ancillary hardware. Four internal splines in the vertical post permit a relatively thin wall tubing to be used by providing rigidity. The splines are also utilized to form a snug fit with flat metal spike elements in conjunction with a novel stabilizer block that fits tightly into the lower end of the post to further hold the spike elements in place and to provide cross sectional rigidity at the base of the post. Similarly, channels extruded into the crossarm section provide rigidity to that portion and serve functionally to support signs. The upper channel, by means of novel plastic inserts, supports small rider signs that are therefore quickly and easily changeable. The bottom channel advantageously accepts sign mounting eye inserts at any point along the arm for maximum flexibility of hanging various size signs. A very strong, lightweight, and low cost spike assembly molded from polycarbonate is provided which easily snaps into the bottom of the sign and may be installed by pressing into the ground with the feet. The combination of the above disclosed elements of the structure of the invention provides economy, utility, and convenience to the user of portable type yard signs not heretofore available.

While a particular preferred embodiment has been described in detail to illustrate the invention, it will be obvious to those of ordinary skill in the art that the same novel features can be adapted to various shapes, sizes, and materials of construction without departing from the spirit and scope of the invention.

I claim:

1. A support post for signs and the like comprising:

a vertical post formed from a hollow metal tube having a plurality of vertical internal splines;

a downward projecting spike assembly attached to the lower end of said vertical post and adapted to be forced into the ground by foot pressure or the like; and a horizontal crossarm attached to said vertical post near the upper end thereof, said horizontal crossarm formed from a hollow metal tube having a first channel formed in the lower surface thereof and a second channel formed in the upper surface thereof, said first channel adapted to accept a plurality of sign supporting eye devices at any selected points along said first channel, said second channel for accepting a plurality of pliable inserts having vertical slots therein for accepting the lower edge of an auxiliary sign whereby said sign is held in a vertical position by friction between said sign and said inserts;

said vertical post having a cutout portion thereof, said cutout portion being cut through at least some of said vertical internal splines, and said horizontal crossarm having a cutout portion thereof adapted to match with and fit into said vertical post cutout, said crossarm cutout portion cut to provide a face of said first channel and a face of said second channel to bear against said vertical post cutout portion, and portions of said upper and lower surfaces arranged to bear against said cut spline surfaces to thereby form a rigid vertical post/horizontal crossarm joint.

2. The support post as defined in claim 1 in which said first channel in said horizontal crossarm is an essentially longitudinal rectangular channel having a downward opening slot formed in said lower surface of said crossarm, said slot having its faces spaced to permit each sign holding eye device to be inserted through said rectangular channel and to be positioned at any point along said rectangular channel.

3. The support post as defined in claim 1 in which:

said spike element includes downward projecting pointed blades for insertion in the ground, a flat horizontal extending portion connected to said downward extending blades forming a step like area to be used for forcing said downward projecting blades into the ground, and a vertical upward extending portion connected to the center area of said step like portion, said upward extending portion having spring loaded pins for temporary attachment of said spike element to the lower end of said vertical post, said upward extending portion formed for matching said vertical splines, and said lower end of said post having holes therethrough for mating with said spring loaded pins in said upward extending portion of said spike element for securing said spike element to said post.

4. The support post as defined in claim 3 in which said spike element is an integral unit molded from polycarbonate plastic resin.

5. The support post as defined in claim 2 in which said eye device includes an upper portion having a shape essentially complementary to said rectangular channel and a lower part having an opening therethrough for accepting a sign hanging hook.

6. The support post as defined in claim 5 in which:

said upper portion includes a vertical slot and in which said shape is slightly larger than said rectangular channel; and said eye device is formed from a slightly resilient plastic material whereby said upper portion may be inserted in said rectangular channel by squeezing said upper channel to close said vertical slot.

7. The support post as defined in claim 1 in which:

said second channel in said horizontal crossarm is an essentially longitudinal cylindrical channel having an upward opening slot formed in said upper surface of said crossarm; and said pliable inserts formed to have a lower portion complementary to the shape of said cylindrical channel to permit insertion into and moving of said inserts along said cylindrical channel.

* * * * *